US006848361B2

(12) United States Patent
Metzler

(10) Patent No.: US 6,848,361 B2
(45) Date of Patent: Feb. 1, 2005

(54) CONTROL DEVICE AND METHOD TO PREVENT REGISTER ERRORS

(75) Inventor: Patrick Metzler, St. Wendel (DE)

(73) Assignee: Eastman Kodak Company, Rochester, NY (US)

( * ) Notice: Subject to any disclaimer, the term of this patent is extended or adjusted under 35 U.S.C. 154(b) by 61 days.

(21) Appl. No.: 10/337,129

(22) Filed: Jan. 6, 2003

(65) Prior Publication Data

US 2004/0089175 A1 May 13, 2004

(30) Foreign Application Priority Data

Jan. 18, 2002 (DE) ..... 102 01 821
Aug. 27, 2002 (DE) ..... 102 39 158

(51) Int. Cl.[7] ..... B41F 5/00
(52) U.S. Cl. ..... 101/216; 101/127; 101/118
(58) Field of Search ..... 101/212–217, 101/5, 6, 23, 36, 37, 52, 53, 74–77, 91, 116, 118, 132, 136, 141, 152, 153, 173, 174, 214, 215, 127–129, 248

(56) References Cited

U.S. PATENT DOCUMENTS 5,551,339 A * 9/1996 Schadlich et al. ..... 101/216
6,112,655 A * 9/2000 Suzuki et al. ..... 101/118
6,283,021 B1 * 9/2001 Watanabe et al. ..... 101/127
6,371,019 B1 * 4/2002 Bosen et al. ..... 101/216
2003/0029341 A1 * 2/2003 Metzler ..... 101/485

FOREIGN PATENT DOCUMENTS

JP 06198858 A * 7/1994 ..... B41F/33/14
JP 11070703 A * 3/1999 ..... B41J/2/525

* cited by examiner

*Primary Examiner*—Minh Chau
(74) *Attorney, Agent, or Firm*—Lawrence P. Kessler

(57) ABSTRACT

A control device for removing register errors on printing machines. The control device for controlling the printing drums for a printing machine has at least a first sensor to detect sheets on a conveyor belt and printing drums to apply printing images, whereby a spacing, which is defined between a position on the conveyor belt determined by a signal of the first sensor and the nip of a printing cylinder on the conveyor belt, corresponding to a whole-numbered multiple of the circumference of a nip roller.

2 Claims, 2 Drawing Sheets

CONTROL DEVICE AND METHOD TO PREVENT REGISTER ERRORS

FIELD OF THE INVENTION

The invention relates to a control device to prevent register errors and a method for the application of the control device.

BACKGROUND OF THE INVENTION

With printing machines, the application in the register of images on the print substrate is of great importance. In particular with multicolor printing, in which the overall colored image includes individual single-colored images that are printed on top of one another, registerability is important. The state of the art discloses a number of documents on this subject.

In one solution, for this purpose, register marks are applied to a conveyor belt or a sheet that are detected with sensors. Automatic deviations were determined in this manner, which were, for example, corrected by servo motors. Each register mark is allocated to an individual single-colored image. By the appropriate arrangement of the register marks, displacements of the register marks in the moving direction of the conveyor belt, so-called intrack deviations, and across from them, so-called crosstrack deviations, are detected. The intrack and crosstrack deviations are non-linear, non-cyclical errors that occur at random. In addition, register errors occur for a reason that is described below. During the application of an image on the sheet, an image-carrying illustration drum or intermediate drum rolls off onto the sheet and transfers the image; and, on the opposite side, a nip roller is arranged, which provides a counteracting force to the pressing force of the illustration drum or intermediate drum. Consequently, the term "printing drum" is used for the terms "illustration drum" and "intermediate drum". The printing drum rolls off the conveyor belt at this point, and is identical to the illustration drum or with the intermediate drum, depending on whether the printing machine uses an intermediate drum or the image is directly transferred from the illustration drum to the conveyor belt.

Ideally, a constant contact force of the nip roller from below the conveyor belt is provided. With a constant contact force, the speed of the printing drum arranged above the conveyor belt remains the same, which does not change its speed due to the changing contact forces with the nip roller. However, out-of-roundness of the nip roller causes contact forces of the of the nip roller on the conveyor belt to change. Consequently, the rubber material of the printing drum, which touches the conveyor belt on the top side, is deformed and its speed changes.

As is understandable, a speed change of the printing drum, illustration drum or intermediate drum carrying the image causes an incorrect application of the image and the register marks on the sheet. The concentricity tolerance of the illustration drum or of the intermediate drum results in an erroneous application of the image and the register marks on the sheet. However, the out-of roundness tolerance of the illustration drum or the intermediate drum causes changing contact forces of the nip roller on the conveyor belt. The higher the contact force of the nip roller, the slower the printing drum, as a result of which the application of the image is delayed. The out-of-roundness tolerances of the illustration drum or the intermediate drum and a nip roller gripping the conveyor belt from the underside can be reduced by manufacturing measures. The disadvantage of this possible solution results in higher costs.

SUMMARY OF THE INVENTION

The purpose of the invention is to avoid the register errors described above. As a solution, a method and a control device are provided to control the printing drums for a printing machine. At least one sensor is provided to detect the sheets on a conveyor belt and printing drums for the application of printing images, whereby a spacing, which is defined as between one of the positions on the cylinder and the nip of a printing drum on the conveyor belt, is determined corresponding to a whole-numbered multiple of the circumference of a nip roller. In addition, a method for controlling printing drums for a printing machine is prepared, in particular for the application of the described control device whereby a sheet is detected by a first sensor, the first sensor generates a signal which releases the illustration by an illustration device, and a nip roller is provided, whereby the spacing between a position allocated to the signal on the conveyor belt and a nip of the printing drum on the conveyor belt corresponds to the whole-numbered multiple of the circumference of the nip roller.

Certain printing machines use an illustration drum with an intermediate drum to transfer the image to the print substrate, which have different angular velocities. An embodiment of such printing machine has a spacing, which is defined by a position determined by the sensor signal on the conveyor belt and the nip of the intermediate drum on the conveyor belt with a first angular position of the illustration drum, and a spacing m, which is defined between a position determined by the sensor signal on the conveyor belt and the nip of the intermediate drum on the conveyor belt with a second angular position of the illustration drum, corresponding to the whole-numbered multiple of the circumference of the nip roller. Register errors in a printing machine, in which an illustration drum and an intermediate drum, which have different angular velocities, are used to transfer the image onto the print substrate, can be avoided in this manner.

BRIEF DESCRIPTION OF THE DRAWINGS

The invention is described in detail below with reference to the attached figures.

DETAILED DESCRIPTION OF THE INVENTION

Figure 1:
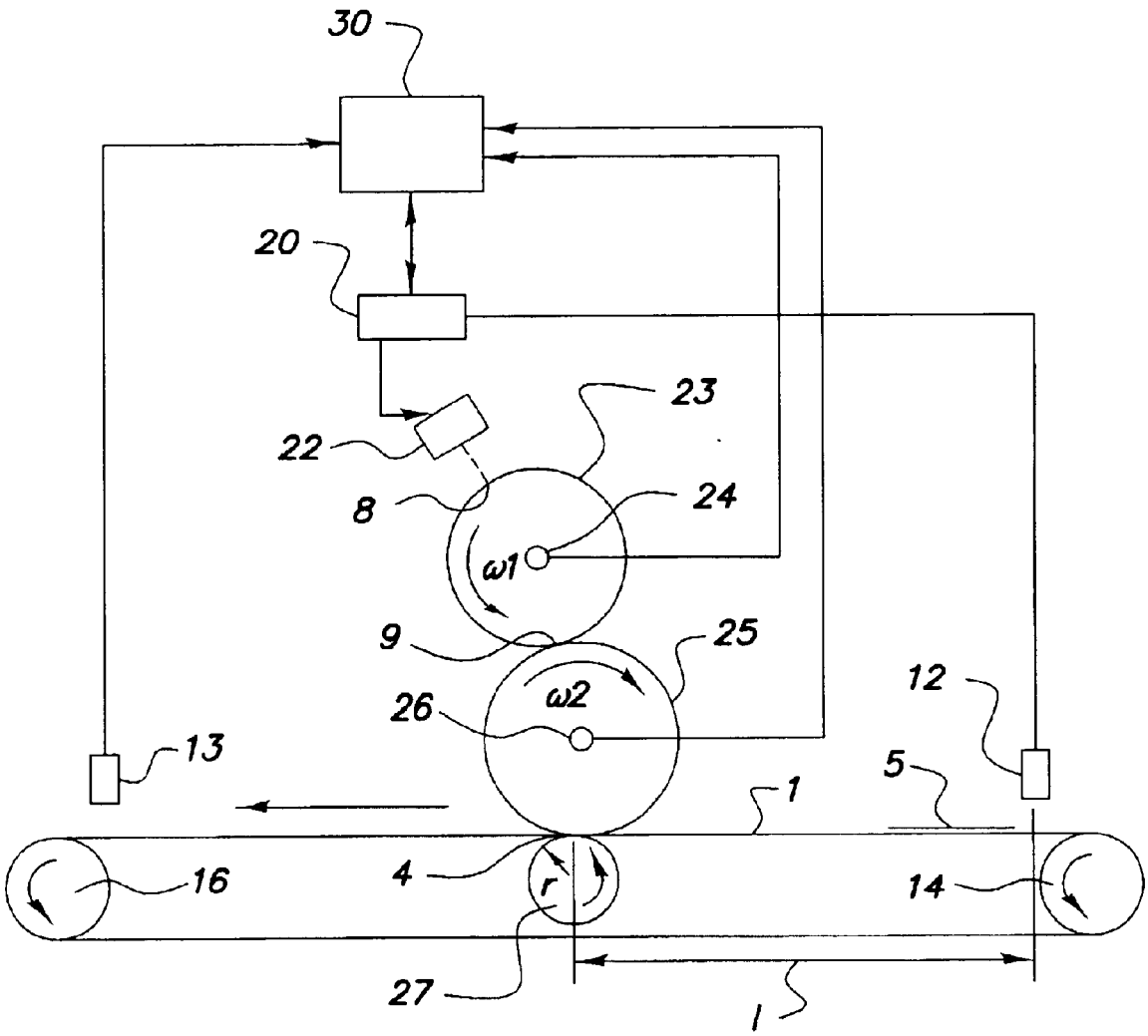
FIG. 1 is a schematic block diagram of a printing module of a printing machine.

FIG. 1 shows a schematic block diagram of a printing module above a conveyor belt 1, moving in the direction of the straight arrow. The conveyor belt 1 is driven by drive on a first deflection pulley 14 and advances sheet 5 through the printing machine. Between the first deflection pulley 14 and a second deflection pulley 16, other rollers are usually arranged, which are not shown in FIG. 1. A first sensor 12 detects the front edge of a sheet 5 and transmits a signal to the pulse counter 20, which is connected to a control device 30. The control device 30 includes allocation tables or look up tables that are registers, which receive data from the first rotary encoder 24, from the second rotary encoder 26, from the drive on the second deflection pulley 16 and from the second sensor 13 or the register sensor 13 and convert them into pulse counts.

The pulse counts obtained from the look up tables are used to specify the time for beginning the illustration of the image. To this end, the pulse counter 20 counts the pulse counts received and gives a release signal to the illustration device 22. The term "image" includes in this context color separations of images of individual printing modules that compose an overall image, such as the color separations cyan, magenta, yellow and black in four-color printing. In FIG. 1, only one printing module for a color separation is illustrated; other substantially identical printing modules can be provided.

After a predetermined number of pulses, the pulse counter 20 transmits a signal to the illustration device 22, which, based on the signal, transmits an image to the illustration drum 23. The image is transferred to the intermediate drum 25, which is rotating in the opposite direction to the illustration drum 23, and which prints the image by rolling the intermediate drum 25 off onto the sheet 5. The intermediate drum 25 exerts a force from above on the conveyor belt 1, and a nip roller 27 with a radius r exerts an opposite force from below on the conveyor belt 1. The illustration drum 23, and of the intermediate drum 25, the second deflection pulley 16 and the nip roller 27 are driven by friction with the conveyor belt 1, which is driven by a drive on the first deflection pulley 14.

The illustration drum 23 and the intermediate drum 25 have a first rotary encoder 24 and a second rotary encoder 26 respectively, which determine the rotation angle of the illustration drum 23, and of the intermediate drum 25. In this manner, it is possible to determine the position of these drums. Due to the illustration device 22, which is released by the pulse counter 20 following the signal transmitted by the first sensor 12, the illustration takes place at the exact time that the image from the illustration drum 23 is transferred with micrometer precision via the intermediate drum 25 onto the sheet 5. The nip roller 27 pushes with a certain force from below against the conveyor belt 1, which is opposed by the pressing force of the intermediate drum 25. Below, according to FIG. 1, it is assumed that the intermediate drum 25 transfers the image to the sheet 5. If the pressing force of the nip roller 27 changes, then the speed of the intermediate drum 25, carrying the toner-covered latent image or the toner-coated image, also changes. This effect leads to errors with the imprinted image.

In FIG. 1, the space between a position at which signals from the first sensor 12 strike, and the printing gap or nip 4 is designated with l. Nip 4 designates the area in which the intermediate drum 25 imprints on the conveyor belt 1. In the current case, the first sensor 12 detects the front edge of a sheet 5 on the conveyor belt 1. In reaction to this signal, a second signal is generated in the control device 30 (the START OF FRAME signal), in response to which the illustration device 22 of the respective printing module prompts the application of the toner images to the illustration drum 23. The toner images are transferred to the intermediate drum 25 and subsequently to the sheet 5. The START OF FRAME signal is transferred to the pulse counter 20, which counts a specific pulse count and, following the counting of this pulse count, the illustration is released by the illustration device 22.

The second sensor 13 at the end of the conveyor belt 1 detects the register marks in a register mark area 6 (see FIG. 2) of sheet 5, and transmits a signal to the control device 30. An actual/target comparison is carried out in the control device 30, whereby the actual values correspond to the data that were delivered by the second sensor 13, and the target data correspond to data that were stored in the control device 30. In this manner, it is determined whether the register marks lay in the desired (target) position, or whether there was an error in the registerability. If an error exists, the illustration time in the illustration device 22, under control of control device 30, is changed in such manner that the error is corrected. In addition, with a particular configuration of the first rotary encoder 24, the rotation angle of the illustration drum 23, and of the second rotary encoder 26, the rotation angle of the intermediate drum 25, are transferred to the control device 30. By a target/actual comparison in the control device 30, it is determined whether the rotation angle of illustration drum 23 and of the intermediate drum 25 are error-free.

Deviations or errors with the rotation angle of the target values lead to errors in illustration, since the image is not transferred to sheet 5 at the proper time. The correction of the defective rotation angles in the illustration drum 23 and the intermediate drum 25 are carried out, in which the pulse count that was counted in the pulse counter 20 up to the time of the illustration is controlled by the control device 30.

Figure 2:
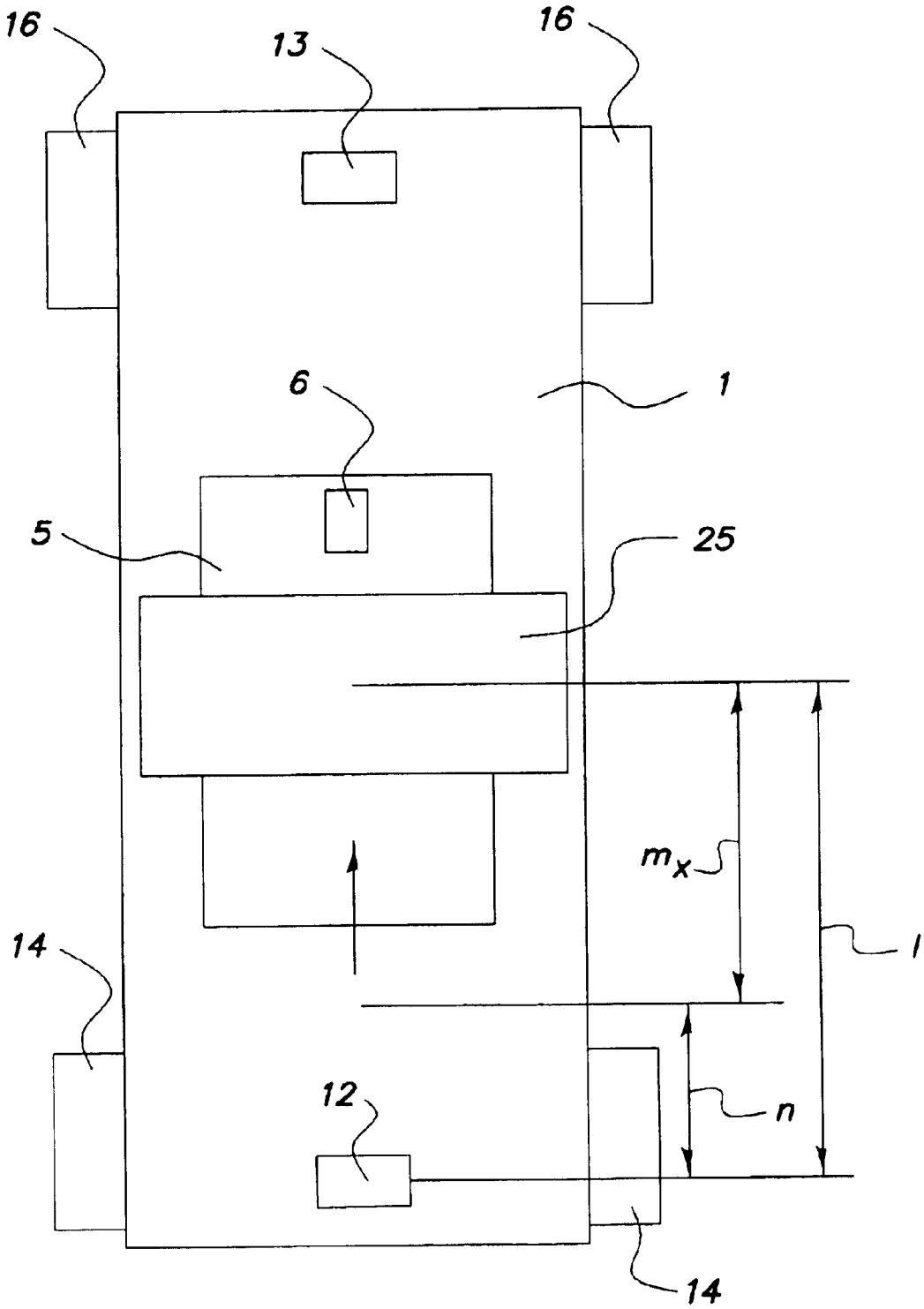
FIG. 2 is a schematic plan view from above a conveyor belt with an illustration drum showing the spacing in connection with the invention.

FIG. 2 shows a top view of a conveyor belt 1 with the second deflection pulley 16 and the first deflection pulley 14. The intermediate drum 25 is arranged above the conveyor belt 1; the illustration drum 23 is not shown. The spacing between a position on the conveyor belt 1, where the signals of the first sensor 12 strike, and the printing gap or nip 4, which is designated with l, is shown. In addition, the spacing $m_x$ is shown, which extends from the generation of the second signal, the START OF FRAME signal, up to the nip 4 below the illustration drum 23. The index x is hereby equal to one, two or three, depending on whether the angular velocity of the illustration drum 23 $\omega_1$ and the intermediate drum 25 $\omega_2$ are the same. In this case, it is hereby assumed that the spacing amounts to $m_1$. In cases of different angular velocities of the illustration drum 23 and the intermediate drum 25, the spacing amounts to $m_2$, or $m_3$, whereby $m_2$ is not equal to $m_3$. The difference between the dimensions l and $m_1$ is indicated by n. The spacing $m_1$ is set in such a manner that this corresponds to a multiple of the circumference $2\pi r$ of the nip roller 27. In this manner register errors are prevented, which are caused by the changing pressing forces of the nip roller 27, as described below.

Out-of-roundness of the nip roller 27 is a function of the angular position of the nip roller. This leads to periodic errors, which are a sinusoidal function, when the error is plotted as a function of time. As a result, the speed of the intermediate drum 25 as well as that of the illustration drum 23 undesirably changes cyclically. Assuming that the transfer ratio of the illustration drum 23 to the intermediate drum 25 is equal to one, then the error-free start of the second signal, START OF FRAME, takes place, if the following condition is met:

$$\frac{(\Delta s_{Illustration\ drum} + \Delta s_{Intermediate\ drum})}{\omega} = \frac{\text{START OF FRAME, NIP}}{v_{Conveyor\ belt}} \qquad \text{Equation 1}$$

whereby $\Delta S_{Illustration\ drum}$ designates the path in the rotation angles, which the illustration drum 23 covers a distance from a first position 8 to a second position 9 (see FIG. 1), at which the image of the illustration drum 23 is transferred to the intermediate drum 25, with $\Delta S_{intermediate\ drum}$ being the path in the rotation angles of the intermediate drum 25 up to nip 4, with $\omega$ being the angular velocity of the two printing drums, $v$, the speed of the conveyor belt 1 and START OF FRAME, NIP, being the spacing between the START OF FRAME signal, which the illustration releases from a frame, and the nip 4. With Equation 1, it is assumed that the two printing drums, in this case the illustration drum 23 and the intermediate drum 25, have the same speed.

If the angular velocity ω, changes undesirably due to the out-of-roundness of the nip roller 27, the following equation is provided:

$$\left[\int_0^{\Delta s1+\Delta s2} \frac{1}{\omega(\varphi)} d\varphi - \frac{(\Delta s1 + \Delta s2)}{\omega_0}\right] * v_{Conveyor\ belt} = \text{Error(START OF FRAME, NIP)} \qquad \text{Equation 2}$$

In Equation 2, Δs1 is equal to $\Delta S_{Illustration\ drum}$, and Δs2 is equal to $\Delta S_{Intermediate\ drum}$. The dimensions Error (START OF FRAME, NIP) designate the spacing error due to the change in the angular velocity ω of the printing drum. If Equation 2 is integrated over entire periods, i.e. over entire cycle of the nip roller 27, the value for the Error (START OF FRAME, NIP) is 0. In Equation 2, subtrahend and minuend cancel each other out. The above proven equations clearly illustrate that the register error, which was caused by the changes in the angular velocity ω due to out-of-roundness of the nip roller 27, is remote, in that the circumference or a whole-numbered multiple of the circumference, i.e. n*2πr, of the nip roller 27 is equal to the spacing, which is defined by a position at the START OF FRAME signal and to the nip 4 on the conveyor belt 1, to the START OF FRAME, NIP spacing. In other words, the out-of-roundness of the nip roller 27 is caused by the same rotation angles of the nip roller 27, which is equal to the register error. In this manner, by setting the spacing of the position on the conveyor belt 1 at the time of the START OF FRAME to nip 4 an error-free illustration would be achieved.

In conclusion, the case is mentioned in which the illustration drum 23 and the intermediate drum 25 have different angular velocities. Then a whole-numbered multiple of the circumference of the nip roller 27 would be selected in such a way that this corresponds to a spacing $m_2$, which is defined between position determined by the signal of a first sensor 12 and the nip 4 of the intermediate drum 25 on the conveyor belt 1 with an angular position $\phi_1$ of the illustration drum 23, and a spacing $m_3$, which is defined between a position determined by a signal from the first sensor 12 and nip 4 of the intermediate drum 25 on the conveyor belt 1 with an angular position $\phi_2$ of the illustration drum 23.

The invention has been described in detail with particular reference to certain preferred embodiments thereof, but it will be understood that variations and modifications can be effected within the spirit and scope of the invention.

What is claimed is:

1. Control device to control printing drums for a printing machine with at least a first sensor (12) to detect sheets (5) on a conveyor belt (1), printing cylinders including an illustration drum (23) and an intermediate drum (25) to apply printing images to sheets (5) in a nip (4) between the intermediate drum (25) and a nip roller (27), said control device comprising: a first spacing, which is defined between a position determined by a signal of the first sensor (12) on the conveyor belt (1) and the nip (4) of the intermediate drum on the conveyor belt (1), corresponding to a whole-numbered multiple of the circumference of a nip roller (27), and with different angular velocities of said illustration drum (23) and said intermediate drum (25) of the printing machine, a second spacing, which is defined between a position determined by the signal of a sensor (12) and the nip (4) of the intermediate drum (25) on the conveyor belt (1) with an angular position $\phi_1$ of the illustration drum (23), and a third spacing, which is defined between a position determined by the signal of a sensor (12) and the nip (4) of the intermediate drum (25) on the conveyor belt (1) with an angular position $\phi_2$ of the illustration drum (23), corresponding to a whole-numbered multiple of the circumference of the nip roller (27).

2. Control device according to claim 1, wherein said first spacing corresponds to the distance, which the image of an illustration position with an illustration device (22) covers from the illustration drum up to the nip (4).

* * * * *